United States Patent [19]

Bernstein et al.

[11] Patent Number: 4,528,777

[45] Date of Patent: Jul. 16, 1985

[54] KNIFE SHARPENER

[75] Inventors: Benjamin T. Bernstein; George M. Toman, both of Northfield, Ill.

[73] Assignee: Ben Bernstein & Associates, Northfield, Ill.

[21] Appl. No.: 575,185

[22] Filed: Jan. 30, 1984

[51] Int. Cl.[3] ..... B24B 7/00

[52] U.S. Cl. ..... 51/40; 51/34 H; 51/35; 51/83 BS; 51/84 BS; 51/92 BS; 51/285

[58] Field of Search ..... 51/34 H, 34 K, 35, 36, 51/40, 41, 74 BS, 83 BS, 84 BS, 91 BS, 92 BS, 285

[56] References Cited

U.S. PATENT DOCUMENTS

| | | | |
|---|---|---|---|
| 181,000 | 8/1876 | Hefft | 51/36 |
| 255,980 | 4/1882 | Henshaw | 51/36 |
| 487,552 | 12/1892 | Cline | 51/36 |
| 593,964 | 11/1897 | Luther | 51/36 |
| 743,033 | 11/1903 | Ridderhof | 51/34 H |
| 1,113,210 | 10/1914 | Goolnik | 51/41 |
| 1,667,719 | 5/1928 | Cooney | 51/34 H |
| 2,000,941 | 5/1935 | Gardner et al. | 51/40 |
| 2,519,542 | 8/1950 | Carey et al. | 51/34 H |
| 2,865,140 | 12/1958 | Shumway | 51/285 |

*Primary Examiner*—Frederick R. Schmidt
*Assistant Examiner*—J. T. Zatarga

[57] ABSTRACT

A knife sharpening device having a grinding element adapted to be moved into the knife edge in a spiral path through a 180° traverse and reverse, simultaneously moving longitudinally throughout the length of the knife's edge. A blade stropping element may be contained as an insert in the grinding element to strop the knife's edge during the reverse traverse.

13 Claims, 3 Drawing Figures

KNIFE SHARPENER

BACKGROUND OF PRIOR DEVICES

In many instances the current technology for automatic sharpening of knife blades depends upon sharpening of the blade by flexible emery bands which traverse the reciprocating blade while the knife is in operation. While the machine is running and the knife blade reciprocating, the operator activates a reversing lead screw causing the sharpening unit down the full length of the reciprocating blade and back up to the stop position During this traverse a drive train rotates two flexible emery bands set at some angle to the blade. The bevel on the knife edge is controlled and maintained by spring loading of the bands against the blade.

There are a number of limitations of the current method of automatic sharpening of knife blades. These are as follows; the flexible emery bands do not maintain an accurate and reproducible contact angle with the reciprocating blade. The rotating emery bands actually grind material away from the blade thus causing the bevel edge material to move towards the edge creating a burred edge. The constant reciprocation of the blade tends to remove the excessive side material and straigten the edge to some extent. The actual cutting edge is being formed by material which has yielded off the beveled face which has been cold worked and no longer has the structural integrity of the base blade. In a number of cases sections of the sharpened edge can break off in the form of a very thin wire. It is extremely difficult to sharpen a harder and more brittle alloy blade using the current method.

It is well known that control of the bevel angle is critical to the application of a knife edge. A utility knife comes in contact with the various materials of different hardness so the edge must be able to resist bending, chipping and flaking. Therefore the blade is sharpened to an angle which cuts yet remains relatively sharp under adverse conditions. This basic angle is 20° to 25° as measured from the centerline of the blade. By contrast, a razor is designed to cut softer material and is not subjected to impact. Therefore a razor can be sharpened to a more acute angle of 7° to 10° as measured from the centerline of the blade.

SUMMARY OF THE INVENTION

It is an object of this invention to reproduce on an automatic knife sharpener, the proven techniques employed in hand sharpening various blades by combination of honing and stropping of the blade edge. The normal motion employed in hand sharpening a blade is to draw the edge into the stone used to sharpen the blade while sliding the blade along its edge. The purpose of this dual motion is to avoid grooving the edge due to irregularities in the stone and/or the blade. Maintenance of the bevel angle is very critical to produce a fine edge. The operation previously described is known as honing the blade. The final step after honing is to strop the blade. Stropping the blade, by such means as a leather strap, tends to straighten the honed edge and also to polish it, thus producing the ultimate sharp edge.

A further object of this invention is to provide a sharpening device wherein the grinding stone is drawn into the edge and along the edge eliminating burring of the edge and smoothing out irregularities. A boxwood insert on the unit acts as a strop to straighten and polish the edge as it moves away from it. The grinding stone can be impregnated with various polishing compounds to further reduce edge irregularities or to sharpen various blade materials.

Still another object of this invention is to provide in a device of this nature a fixed geometry, that guarantees that the critical bevel angle is maintained at every point along the edge, irregardless of edge contour. Grinding stones ranging from soft sand stone to diamond may be selected to sharpen any blade material desired, including stainless steel and titanium carbide.

A number of variations of the basic configuration described are possible and can be readily constructed. The concept described above is applicable to many commercial practices including, but not limited to, cloth cutting equipment, cutlery, food slicer, tool and saw sharpeners, restaurant and butcher knife sharpening, surgical tool sharpening, farm tools and household sharpeners.

DESCRIPTION OF DRAWINGS

The invention will be best understood by reference to the accompanying drawings which illustrate the preferred form of construction by which the stated objects of this invention are achieved and in which.

GENERAL DESCRIPTION

Figure 1:
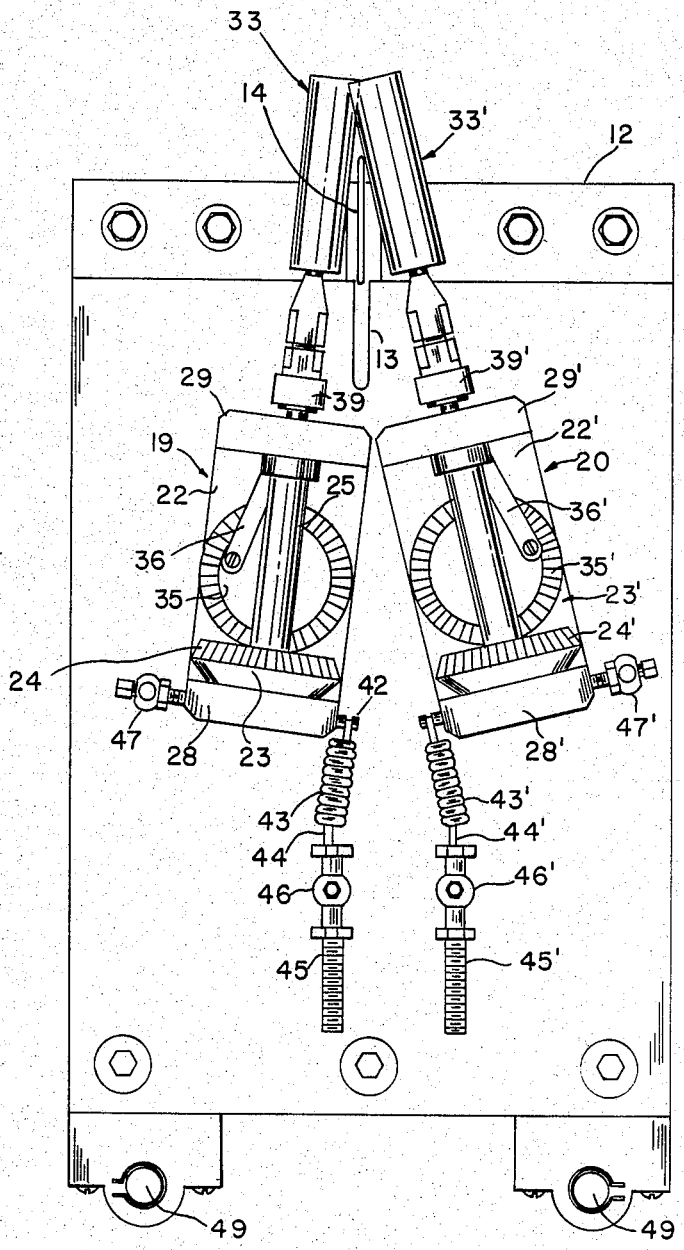
FIG. 1 is a front elevational view of the invention.

The knife sharpener 10 of this invention as illustrated in FIG. 1 includes a mounting plate 11, the top wall 12 of which is slotted at 13 to accommodate a knife blade support 14.

Figure 2:
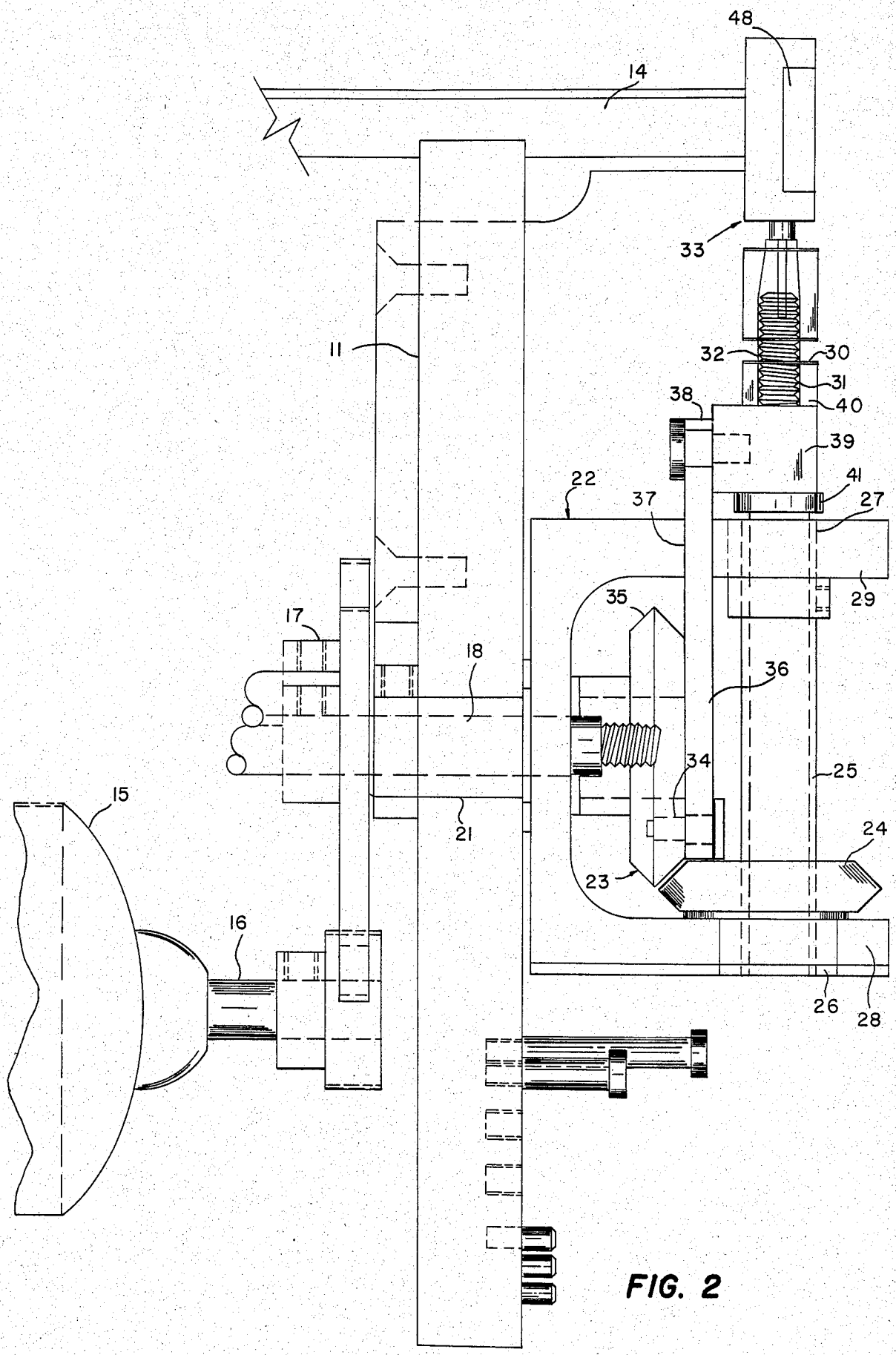
FIG. 2 is a fragmentary side elevational view of the invention.

As shown in FIG. 2, to the one side of the mounting plate 11, there is a power source 15 which through a drive shaft 16 and a gear train 17 is adapted to rotate the drive shaft 18 of each sharpener unit as shown.

The sharpener 10 may include two sharpener units 19 and 20 each having the same structural arrangement and operational functions. By reason of the similarity, only one unit 19 will be specifically described, with corresponding primed numbers referencing corresponding structure in the second unit 20.

Freely journalled on a suitable bearing 21, projecting through the mounting plate 11, is U-shaped bracket 22. Also extending through the bearing 21 is the drive shaft 18 which supports at its free end a mitered gear set 23. Gear 24 is fixed to a spline drive shaft 25 which extends through suitable bearings 26 and 27 formed in the spaced arms 28 and 29 of the U-shaped bracket 22.

The upper free end 30 of the spline drive shaft 25 is counterbored as at 31 to threadably receive the connecting stud 32 of a grinding stone 33.

Mounted as at 34 at a point adjacent to the periphery of gear 35 of the mitered gear set 23 is one end of a connecting rod 36. This rod extends through an opening 37 formed in the upper arm 28 of the U-shaped bracket 22 with its opposite end 38 connected to a bushing journalled on the spline drive shaft 25. The bushing 39 is positioned between fixed collars 40 and 41 mounted on the shaft 25 for a purpose here and after made apparent.

Figure 3:
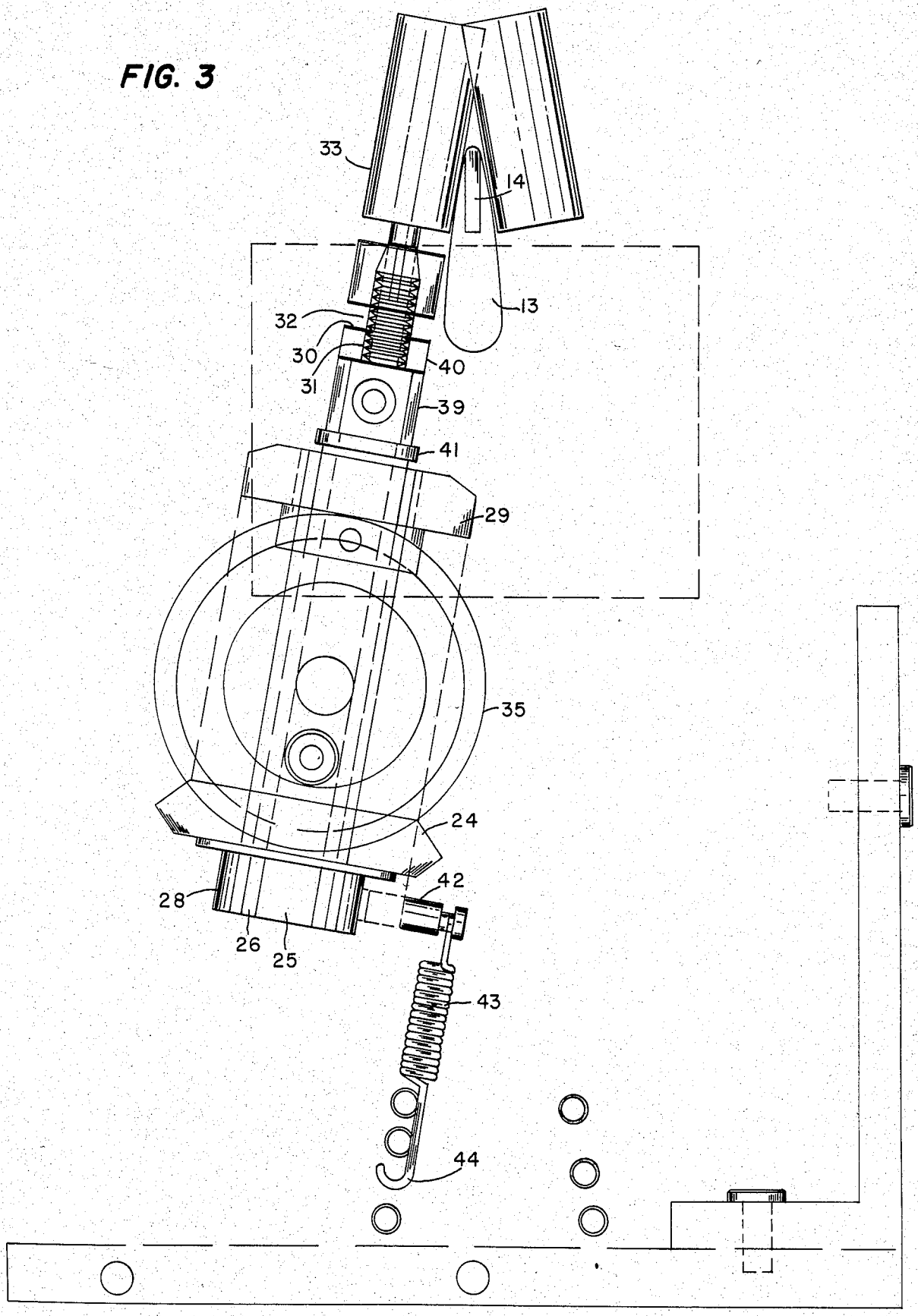
FIG. 3 is an enlarged front elevational view of on sharpener unit of the invention.

Referring to FIGS. 1 and 3 there is shown a structure by which the U-shaped bracket 22 may be rotationally positioned about the gear 35 and drive shaft 18. As illustrated the arm 29 of the bracket 22 provides a stud 42 which has attached thereto one end of a coil spring 43. The opposite end 44 of the spring 43 is attached to a threaded bolt 45 which may be moved longitudinally through a fixed mounting 46. By this arrangement it is readily apparent that the bracket 22 and the grinding stone 33 may be yieldably adjusted in a clockwise direction as illustrated in FIG. 3.

To position the bracket 22 in a counter-clockwise direction there is provided a threadable bolt assembly 47 having engagement with the opposite side of the leg 29.

From the forgoing description it is apparent that by rotation of the mitered gear set 23 the spline drive shaft 25 will complete one cycle of revolution as well as being shifted longitudinally of its length and reversely returned to its starting position. Thus the grinding stone 33 will have been caused to move into and hone the knife's edge, in a spiral path, for 180 degrees of traverse and reverse. Through the arrangement of the spring 43 the grinding stone 33 will be able to follow the existing blade edge thus assuring a reproductable sharpening angle thereon.

In the event that the grinding stone 33 is provided with a stropping element 48 (see FIG. 2), such as a boxwood insert, the reverse longitudinal movement of the shaft 25 during the second half of its complete cycle will bring the insert 48 across the knife's edge so as to produce a stropping action.

To completely treat the knife blade, it can be moved throughout its length transverse to the grinding stone, by any suitable mechanism. However in some instances, it is more feasible to move the sharpener relatively to a stationary blade. To accomplish this movement, the mounting plate 11 could be journalled upon guide rods 49 (see FIG. 1), and be moved thereover as a complete unit.

A number of variations to the basic configuration described are possible and can be readily constructed. The concept described above is applicable to many commercial practices including, but not limited to, cloth cutting equipment, cutlery, food slicer, tool and saw sharpeners, restaurant and butcher knife sharpening, surgical tool sharpening, farm tools and household sharpeners.

While we have illustrated and described the preferred form of construction for carrying our invention into effect this is capable of variation and modification without departing from the spirit of the invention. We, therefore, do not wish to be limited to the precise details of construction as set forth but desire to avail ourselves of such variations and modifications as come within the scope of the appended claims.

Having thus described our invention what we claim as new and desire to secure Letters Patent is:

1. A sharpener for knife blades comprising:

(a) a stationary mounting plate providing a groove for receiving and retaining a blade to be sharpened, (b) an elongated knife blade positioned in said groove of said mounting plate, (c) a U-shaped bracket pivotally mounted on one side of said plate beneath and to one side of said groove, (d) a grinding element carried by an elongated shaft which is rotatably journalled through the spaced parallel arms of said U-shaped bracket with said shaft extending parallel to said mounting plate and being of such a length as to position said grinding element in contact with an edge of said blade, (e) means mounted on said one side of said plate for rotating said shaft and said grinding element about their longitudinal axes, (f) means connected to said means for rotating said shaft and extending in the same plane as said grinding element and mounted on said shaft for simultaneously moving said element axially through a reciprocal path with respect to the edge of said knife, and (g) means for maintaining constant contact between said grinding element and the edge of said knife.

2. A knife sharpener as defined by claim 1, wherein said means for rotating said element about its longitudinal axis comprises a set of mitered bevel gears having intersecting axes, and a spline drive bar connected thereto, supporting said grinding element.

3. A knife sharpener as defined by claim 2, wherein said means for moving said grinding element axially through a reciprocal path with respect to the knife's edge comprises a connecting rod having one end rotatably connected to one of said bevel gears and its other end pivotally connected to a coupling mounted on said spline drive bar.

4. A knife sharpener as defined by claim 1, wherein said grinding element comprises a elongated circular grinding stone.

5. A knife sharpener as defined by claim 4 wherein said means for rotating said element about its longitudinal axis comprises a set of mitered bevel gears having intersecting axes, and a spline drive bar connected thereto, supporting said grinding element.

6. A knife sharpener as defined by claim 4 wherein said means for moving said grinding element axially through a reciprocal path with respect to the knife's edge comprises a connecting rod having one end rotatably connected to one of said bevel gears and its other end pivotally connected to a coupling mounted on said spline drive bar.

7. A knife sharpener as defined by claim 4 wherein said grinding stone has a blade stropping insert for engaging the edge of the knife to be sharpened during a preselected portion of the said stone's axial movement.

8. A knife sharpener as defined by claim 7, wherein said means for rotating said element about its longitudinal axis comprises a set of mitered bevel gears having intersecting axes, and a spline drive bar connected thereto, supporting said grinding element.

9. A knife sharpener as defined by claim 7, wherein said means for moving said grinding element axially through a reciprocal path with respect to the knife's edge comprises a connecting rod having one end rotatably connected to one of said bevel gears and its other end pivotally connected to a coupling mounted on said spline drive bar.

10. A knife sharpener as defined by claim 1, wherein said means for maintaining constant angular contact with the knife's edge is a spring extending between a fixed point and said means for supporting said grinding element in said angular relation.

11. A knife sharpener as defined by claim 10, wherein said means for rotating said element about its longitudinal axis comprises a set of mitered bevel gears having intersecting axes, and a spline drive bar connected thereto, supporting said grinding element.

12. A knife sharpener as defined by claim 10, wherein said means for moving said grinding element axially through a reciprocal path with respect to the knife's edge comprises a connecting rod having one end rotatably connected to one of said bevel gears and its other end pivotally connected to a coupling mounted on said spline drive bar.

13. A knife sharpener as defined by claim 10, wherein said grinding stone has a blade stropping insert for engaging the edge of the knife to be sharpened during a preselected portion of the said stone's axial movement.

* * * * *